US005873771A

United States Patent [19]

Uesugi

[11] Patent Number: 5,873,771

[45] Date of Patent: Feb. 23, 1999

[54] PROCESS FOR MANUFACTURING LITHOGRAPHIC PRINTING PLATE SUPPORT

[75] Inventor: Akio Uesugi, Shizuoka, Japan

[73] Assignee: Fuji Photo Film Co., Ltd., Kanagawa, Japan

[21] Appl. No.: 791,168

[22] Filed: Jan. 30, 1997

[30] Foreign Application Priority Data

Feb. 2, 1996 [JP] Japan ..... 8-017667

[51] Int. Cl.[6] ..... B24B 1/00; C25D 5/44

[52] U.S. Cl. ..... 454/36; 451/59; 205/214; 205/662

[58] Field of Search ..... 205/214, 661, 205/662; 430/278.1, 302; 451/36, 37, 59

[56] References Cited

U.S. PATENT DOCUMENTS

| | | | |
|---|---|---|---|
| 5,432,046 | 7/1995 | Wanat et al. | 430/278 |
| 5,651,871 | 7/1997 | Fromson et al. | 205/50 |

FOREIGN PATENT DOCUMENTS

| | | |
|---|---|---|
| 0213371 | 3/1987 | European Pat. Off. . |
| 0595179 | 5/1994 | European Pat. Off. . |
| 0704320 | 4/1996 | European Pat. Off. . |
| 5040047 | 12/1975 | Japan . |
| 62-027191 | 2/1987 | Japan . |
| 7137474 | 5/1995 | Japan . |

OTHER PUBLICATIONS

J. Brandrup et al., "Polymer Handbook / Chapter V"; 1989; p. 30; table IIA; p. 31; table IIB.

*Primary Examiner*—Timothy V. Eley
*Attorney, Agent, or Firm*—Sughrue, Mion, Zinn, Macpeak & Seas, PLLC

[57] ABSTRACT

A process for manufacturing a lithographic printing plate support made of aluminum or an aluminum alloy, in which the surface of the support is mechanically roughened by graining it with a brush comprising bristles which have a bending elastic modulus of 10,000 to 40,000 kg/cm$^2$ and a nerve of 500 g or less per bristle, whereby generation of defective products due to defects such as scratching which aluminum itself has can be prevented and a lithographic printing plate support having scumming reduction even on squeezing water out can be provided.

5 Claims, No Drawings

PROCESS FOR MANUFACTURING LITHOGRAPHIC PRINTING PLATE SUPPORT

FIELD OF THE INVENTION

The present invention relates to a process for manufacturing a lithographic printing plate support, and particularly to a process for manufacturing the lithographic printing plate support made of aluminum or an aluminum alloy.

BACKGROUND OF THE INVENTION

Printing plate supports, particularly, lithographic printing plate supports are made of aluminum or aluminum alloys.

In general, aluminum plates used as lithographic printing plate supports are required to have moderate adhesion to photosensitive materials and moderate water receptivity, and further, uniformly roughened surfaces. The uniformly roughened surfaces mean that the surfaces possess pits which are moderately uniform in size and such pits are uniformly formed throughout the surfaces. The pits have a marked effect on printability of plate materials such as scumming reduction and printing durability, and the conditions of the pits are an important element in the manufacture of the plate materials.

A process for manufacturing lithographic printing plate supports which comprises graining a plate material with a brush having large stiffness to form a rough surface with directional properties followed by roughening mechanically the surface is proposned in JP-A-7-137474 (The term "JP-A" as used herein means an "unexamined published Japanese patent application").

Although the proposal made by JP-A-7-137474 excellently prevents generating defective products owing to defects such as scratching which aluminum itself has, the proposal however requires an additional step for forming a rough surface with the directional properties to incur very high cost, and in addition, the plate material thus obtained has the disadvantage of having poor scumming reduction especially on squeezing water out, because of the directional properties.

SUMMARY OF THE INVENTION

An object of the present invention is to provide a process for manufacturing a lithographic printing plate support in which generation of defective products owing to defects such as scratching which aluminum itself has can be avoided and a lithographic printing plate support having scumming reduction even on squeezing water out can be manufactured.

The above-mentioned object of the invention can be achieved by a process for manufacturing a lithographic printing plate support made of aluminum or an aluminum alloy, in which the surface of the support is mechanically roughened with a brush comprising bristles which have a bending elastic modulus of 10,000 to 40,000 kg/cm$^2$ and a nerve of 500 g or less per bristle. Further, it is preferred to use an abrasive material having an average particle size of 10 to 80 $\mu$m in the above-mentioned mechanical roughening of the surface. Furthermore, it is suitable for said abrasive material to have a specific gravity of 2 or more.

DETAILED DESCRIPTION OF THE INVENTION

The gist of the present invention is concerned with the practice of mechanical roughening of the surface in a process for manufacturing a lithographic printing plate support, in which the surface of a plate made of aluminum or an aluminum alloy is mechanically roughened with a brush comprising bristles which have a bending elastic modulus of 10,000 to 40,000 kg/cm$^2$ and a nerve of 500 g or less per bristle by use of an abrasive material. In order to obtain an uniformly roughened surface, this brush roughening of a surface is preferably performed according to a procedure described in JP-B-50-40047 (The term "JP-B" as used herein means an "examined Japanese patent publication"). Although brushes having various structures have been proposed and the brushes are selected from the viewpoint of cost, working properties, or the like, it is important in the present invention for the brush bristles to observe the scope of the present invention, and all types of brushes can be used, as long as the above conditions are satisfied.

The brush bristles need to have flexibility to the extent that unevenness is formed on an aluminum surface. In addition, it is important that the nerve of the bristles be in an appropriate range. If the bristles are too stiff (i.e., have a very high nerve), then localized uneven areas tend to form on the surface when the brush is used in combination with an abrasive material. Printing ink may become entrapped in these uneven areas during the printing process, causing scumming. The flexibility is herein represented by a bending elastic modulus, and the nerve of a bristle is defined as a maximum value of the force imposed on a load cell equipped with a slip resistance by moving the bristle at a rate of 5 mm/sec. In the present invention, the nerve of a bristle needs to be 500 g or less as described above.

It is important for a brush bristle to satisfy the values of the physical properties regulated above regardless of the size of the bristle. Although the most pertinent size of the bristle varies depending on the material of the bristle, diameter generally ranges from about 0.07 to about 2.2 mm from the viewpoint of cost and manufacturing stabilization. A brush roll is composed of nylon, polypropylene, animal fur, or the like, and it is necessary for them to satisfy the values of the physical properties regulated above as well as the sizes. The brush bristles are prepared so as to have uniform length. The bristles having a length of 5 mm or less shorten a time interval of the exchange of the brushes owing to wear, and therefore, preferred length of the bristles is 5 mm or more. Suitable rotation speed of the brush is from 100 to 2000 rpm. A supporting roll having a rubber or metallic surface and maintaining precise straightness is employed.

A slurry of an abrasive material is spread with a spray or the like over a transported aluminum plate before the plate passes the brush roll. The surface of the aluminum plate pressurized by the brush roll is roughened between the supporting roll and the brush roll under a constant pressure.

Examples of the abrasive materials used include alumina, aluminum hydroxide, zirconia, pumice, and metal powder, and the abrasive materials preferably have a specific gravity of 2 or more, and more preferably a specific gravitiy from 2.5 to 8 from the viewpoint of graining. It is important that the particle sizes of the abrasive materials are on average from 10 $\mu$m to 80 $\mu$m, more preferably from 20 $\mu$m to 60 $\mu$m to obtain an uniformly roughened surface.

In the process for manufacturing the lithographic printing plate support of the present invention, materials used for other treatments than the above-mentioned mechanical roughening of the surface and procedures of these treatments are described in detail below.

The materials for the support are pure aluminum or aluminum alloys as described above. Various alloys of aluminum with other elements such as silicon, copper, manganese, magnesium, chromium, zinc, lead, nickel and bismuth can be used. Of various aluminum alloys, JP-B-5-86635 specifies, for example, as offset printing plate materials intermetallic compounds in which other components of the aluminum alloy are limited to iron and silicon. Further, JP-B-55-28874 discloses that plate materials are subjected to cool rolling, intermediate annealing, and electrolytic roughening of the surfaces in which the voltage applying method is specified. The aluminum alloys used in the present invention include not only aluminum alloys as described in JP-B-62-413034, JP-B-1-46577, JP-B-1-46578, JP-B-1-47545, JP-B-1-35910, JP-B-63-60823, JP-B-63-60824, JP-B-4-13417, JP-B-4-19290, JP-B-4-19291, JP-B-4-19293, JP-B-62-50540, JP-A-61-272357, JP-A-62-74060, JP-A-61-201747, JP-A-63-143234, JP-A-63-143235, JP-A-63-255338, JP-A-1-283350, British Patent 272,528, U.S. Pat. Nos. 4,902,353 and 4,818,300, British Patent 394,816, U.S. Pat. No. 5,019,188, German Patent 3,232,810, U.S. Pat. No. 4,435,230, British Patent 239,995, U.S. Pat. No. 4,822,715, German Patent 3,507,402, U.S. Pat. No. 4,715,903, German Patent 3,507,402, British Patent 289,844, U.S. Pat. Nos. 5,009,722 and 4,945,004, German Patent 3,714,059, U.S. Pat. Nos. 4,686,083 and 4,861,396, British Patent 158,941, etc, but also all common aluminum alloys. Recent specifications with reference to the process for manufacturing plate materials disclose a process utilizing a continuous casting as well as a process using hot rolling. For example, German Patent 252,799 introduces a twin roll system into the manufacture of the plate materials. British Patent 223,737, and U.S. Pat. Nos. 4,802,935 and 4,800,950 disclose plate materials in which trace elements of an alloy component are restricted. British Patent 415,238 proposes continuous casting or continuous casting plus hot rolling for the manufacture of the plate materials.

Subsequently, conditions of the treatments for manufacturing the lithographic printing plate supports from aluminum plates or aluminum alloy plates are described below.

In some cases, a preliminary treatment may be performed to remove rolling oil from aluminum surfaces and to disclose clean aluminum surfaces. Solvents such as trichlene or surfactants are used for the former, whereas alkaline etching agents such as sodium hydroxide or potassium hydroxide are widely used for the latter.

Degreasing is mentioned in JP-A-2-026793. For example, degreasing due to solvents is performed by use of petroleum solvents such as gasoline, kerosine, benzine, solvent naphtha, and n-hexane, or by use of chlorinated solvents such as trichloroethylene, methylene chloride, perchloroethylene, and 1,1,1-trichloroethane. Degreasing due to alkali is performed by use of soda salts such as sodium hydroxide, sodium carbonate, sodium bicarbonate, and sodium sulfate; by use of aqueous solutions of silicates such as sodium orthosilicate, sodium metasilicate, sodium disilicate, and sodium trisilicate; or by use of aqueous solutions of phosphates such as sodium primary phosphate, sodium tertiary phosphate, sodium secondary phosphate, sodium tripolyphosphate, sodium pyrophosphate, and sodium hexametaphosphate. The degreasing due to alkali involves the risk of dissolving the surfaces of aluminum plates depending on the time or temperature of the treatment, and therefore, the degreasing should be performed with caution so as not to be accompanied by the dissolution. The degreasing due to surfactants can be performed by use of aqueous solutions of commercially available surfactants of various types, such as anionic surfactants, cationic surfactants, nonionic surfactants, or amphoteric surfactants. Methods of degreasing include those such as dipping, spraying, rubbing with a piece of cloth soaked with the liquids, or the like. Supersonic waves may be used for the dipping and spraying methods.

After the surfaces are cleaned as described above, the mechanical roughening of the surface in the present invention is carried out.

When electrochemical roughening of the surface is successively performed, ununiformly roughened surfaces are formed, which must therefore be etched with alkaline solutions. Examples of acids or alkalis used for this purpose include phosphoric acid, sulfuric acid, hydrochloric acid, nitric acid, sodium hydroxide, soda salts such as sodium carbonate, sodium bicarbonate, and sodium sulfate, aqueous solutions of silicates such as sodium orthosilicate, sodium metasilicate, sodium disilicate, and sodium trisilicate, and aqueous solutions of phosphates such as sodium primary phosphate, sodium tertiary phosphate, sodium secondary phosphate, sodium tripolyphosphate, sodium pyrophosphate, and sodium hexamethaphosphate. The conditions of the treatment are suitably selected from the respective ranges of a concentration of 0.01 to 50%, a temperature of 20° to 90° C. and a period of 5 seconds to 5 minutes. The amount of aluminum etched is suitably determined depending on the aluminum material and its quality expected. JP-A-54-65607 and JP-A-55-125299 propose the preliminary treatment for the electrochemical roughening of the surface. Although various types of the preliminary treatment are described in JP-A-63-235500, JP-A-63-307990, JP-A-1-127388, JP-A-1-160790, JP-A-1-136789, JP-A-1-136788, JP-A-1-178497, JP-A-1-308689, JP-A-3-126891, JP-A-3-126900, JP-A-3-173800, etc., the preliminary treatment in the present invention is not necessarily limited to these types. However, the chemical treatment of the aluminum with these aqueous acids or alkalis like this forms undissolved portions or smuts on the surfaces thereof. These smuts can be removed by phosphoric acid, nitric acid, sulfuric acid, chromic acid, or a mixture thereof. In the present invention, the aluminum plates undergoing the electrochemical roughening of the surfaces are desired to have clean surfaces free from smuts, and use of acidic electrolytes having desmutting action however makes it possible to omit this step.

The aluminum plates thus treated are subjected to the electrochemical roughening of the surfaces as necessary. Electrochemical graining is described in JP-B-48-28123 and British Patent 896,563 Although the electrolytic graining is performed by use of conventional sine wave alternating current, special waveform as described in JP-A-52-58602 may be used for the same purpose. Processes as described in JP-A-55-158298, JP-A-56-28898, JP-A-52-58602, JP-A-52-152302, JP-A-54-85802, JP-A-60-190392, JP-A-58-120531, JP-A-63-176187, JP-A-60-147394, JP-A-1-5889, JP-A-1-280590, JP-A-1-118489, JP-A-1-148592, JP-A-1-178496, JP-A-1-188395, JP-A-1-154797, JP-A-2-235794, JP-A-3-260100, JP-A-3-253600, JP-A-4-72099, JP-A-4-72098, JP-A-3-267400, JP-A-1-141094, etc. can also be applied to the electrolytic graining. The frequency determined by an electrolytic condenser as well as the above-mentioned ones can also be employed. For example, it is disclosed by U.S. Pat. Nos. 4,276,129 and 4,676,879. Usable electrolytes include, in addition to the above-mentioned ones such as nitric acid and hydrochloric acid, those which are described in U.S. Pat. Nos. 4,671,859, 4,667,576, 4,661,219, 4,618,405, 4,626,328, 4,600,482, 4,566,960, 4,566,958, 4,566,959, 4,416,972, 4,374,710, 4,336,113, and 4,184,932. Various proposals for electrolytic cells and power sources have been made, which are described in U.S. Pat. No. 4,203,637, JP-A-56-123400, JP-A-57-59770, JP-A-53-12738, JP-A-53-32821, JP-A-53-32822, JP-A-53-32823, JP-A-55-122896, JP-A-55-132884, JP-A-62-127500, JP-A-1-52100, JP-A-1-52098, JP-A-60-67700, JP-A-1-230800, JP-A-3-257199, etc. In addition to the above specifications, various proposals for the electrolytic cells and power sources which are described, for example, in JP-A-52-58602, JP-A-52-152302, JP-A-53-12738, JP-A-53-12739, JP-A-53-32821, JP-A-53-32822, JP-A-53-32833, JP-A-53-32824, JP-A-53-32825, JP-A-54-85802, JP-A-55-122896, JP-A-55-132884, JP-B-48-28123, JP-B-51-7081, JP-A-52-133838, JP-A-52-133840, JP-A-52-133844, JP-A-52-133845, JP-A-53-149135, JP-A-54-146234, can also be, of course, applied to the present invention.

The samples thus obtained are treated with an alkali or an acid as required. The samples are treated with an alkali as described in JP-A-56-51388, or desmutted with sulfuric acid as described in JP-A-53-12739. Or they are treated with phosphoric acid as described in JP-A-53-115302. Procedures as described in JP-A-60-8091, JP-A-63-176188, JP-A-1-38291, JP-A-1-127389, JP-A-1-188699, JP-A-3-177600, JP-A-3-126891, JP-A-3-191100, etc. can also be employed.

It is preferred that anodized film is formed on the surfaces of the aluminum supports thus obtained. The anodized film can be formed when current is allowed to flow by use of the aluminum support as the anode in an electrolyte such as an aqueous or nonaqueous solution of sulfuric acid, phosphoric acid, chromic acid, oxalic acid, sulfamic acid, benzenesulfonic acid, or a mixture of two or more acids thereof. Although conditions of the anodizing widely vary depending on the electrolyte used and therefore can not be definitely determined, the anodizing is suitably carried out, in general, under the following conditions; from 1 to 80% by weight in concentration of the electrolytes, from 5° to 70° C. in temperature of the electrolytes, from 0.5 to 60 A/dm$^2$ in current density, from 1 to 100 v in voltage, and from 15 seconds to 50 minutes in electrolytic time. An electrolytic cell in which a system of power feed to the electrolyte is used is introduced by JP-A-48-26638, JP-A-47-18739, JP-B-5824517, etc. Further, as a matter of course, processes as described in JP-A-54-81133, JP-A-57-47894, JP-A-57-51289, JP-A-57-51290, JP-A-57-54300, JP-A-57-57896, JP-A-58-107498, JP-A-60-200256, JP-A-62-136596, JP-A-63-176494, JP-A-4-176899, JP-A-4-176789, JP-A-4-280997, etc. can also be employed. Processing solutions as described in JP-A-3-253596, JP-A-62-82089, JP-A-1-133794, JP-A-54-32424, etc. can also be employed.

The support having the anodized film formed is then etched to ensure the adhesion of the support to a photosensitive composition as mentioned above, and then may be subjected to pore sealing treatment with steam or hot water, as a post treatment of anodized film formation, with the aid of a pore sealing device for the support (JP-B-56-12518) to obtain a photosensitive printing plate having good aging stability, good developing properties, and good resistance to scumming in non-image areas. The pore sealing may be performed by the use of devices or by methods as described in JP-A-5-202496, JP-A-5-179482, JP-A-4-4194, etc.

In addition, the following treatments may be performed; treatment with potassium fluorozirconate described in U.S. Pat. No. 2,946,638, treatment with phosphomolybdate described in U.S. Pat. No. 3,201,247, treatment with alkyl titanate described in British Patent 1,108,559, treatment with polyacrylic acid described in German Patent 1,091,433, treatment with polyvinylphosphonic acid described in German Patent 1,134,093 and British Patent 1,230,447, treatment with phosphonic acid described in JP-B-44-6409, treatment with phytic acid described in U.S. Pat. No. 3,307,951, treatment with a lipophilic organic high polymeric compound and a divalent metal salt described in JP-A-58-16893 and JP-A-58-18291, formation of an undercoat layer composed of a hydrophilic cellulose (for example, carboxymethyl cellulose) containing a water-soluble metal salt (for example, zinc acetate) as described in U.S. Pat. No. 3,860,426, hydrophilic treatment due to formation of an undercoat layer by a water-soluble polymer containing sulfonic acid groups as described in JP-A-59-101651, undercoating with phosphoric acid salts described in JP-A-62-019494, water-soluble epoxy compounds described in JP-A-62-033692, phosphoric acid-modified starch described in JP-A-62-097892, diamine compounds described in JP-A-63-056498, inorganic or organic salts of amino acids described in JP-A-63-130391, organic phosphonic acids containing a carboxyl groups or a hydroxyl groups described in JP-A-63-145092, compounds containing an amino group and a phosphonic acid group described in JP-A-63-165183, particular carboxylic acid derivatives described in JP-A-2-316290, phosphoric esters described in JP-A-3-215095, compounds containing one amino group and one phosphorus oxygen acid group described in JP-A-3-261592, aliphatic or aromatic phosphonic acids such as phenylphosphonic acid described in JP-A-5-246171, compounds containing a sulfur atom such as thiosalicylic acid described in JP-A-1-307745, and compounds containing a phosphorus oxygen acid group described in JP-A-4-282637, and coloring by acid dyes described in JP-A-60-64352.

Photosensitive layers given below are provided on the support of the present invention to obtain photosensitive lithographic printing plates.

[I] Formation of Photosensitive Layer Containing o-Naphthoquinonediazidosulfonic Ester and Novolak Resin Prepared from Phenol/Cresol Mixture:

o-Quinonediazido compounds mean o-naphthoquinonediazido compounds, which are described, for example, in U.S. Pat. Nos. 2,766,118, 2,767,092, 2,772,972, 2,859,112, 3,102,809, 3,106,465, 3,635,709, and 3,647,443, and a number of other publications. They can be appropriately employed for this purpose. Of these compounds, o-naphthoquinonediazidosulfonic esters and o-naphthoquinonediazidocarboxylic esters of aromatic hydroxy compounds, and o-naphthoquinonediazidosulfonamides and o-naphthoquinonediazidocarboxylic acid amides of aromatic amino compounds are particularly preferred. Very superior examples of the compounds include esterification products of pyrogallol/acetone condensation products with o-naphthoquinonediazidosulfonic esters as described in U.S. Pat. No. 3,635,709, esterification products of polyesters containing terminal hydroxyl groups with o-naphthoquinonediazidosulfonic acids or o-naphthoquinonediazidocarboxylic acids as described in U.S. Pat. No. 4,028,111, esterification products of p-hydroxystyrene homopolymer or p-hydroxystyrene/other monomer copolymers with o-naphthoquinonediazidosulfonic acids or o-naphthoquinonediazidocarboxylic acids as described in British Patent 1,494,043, and amidation products of p-aminostyrene/other monomer copolymers with o-naphthoquinonediazidosulfonic acids or o-naphthoquinonediazidocarboxylic acids as described in U.S. Pat. No. 3,759,711.

Although these o-quinonediazido compounds can be singly employed, it is preferred to use mixtures thereof with alkali-soluble resins. Appropriate alkali-soluble resins are novolak type phenol resins, examples of which include phenol/formaldehyde resins, o-cresol/formaldehyde resins, and m-cresol/formaldehyde resins. Simultaneous use of the above-mentioned phenol resins and condensation products of phenol or cresol substituted by an alkyl group having 3 to 8 carbon atoms with formaldehyde such as a t-butylphenol/formaldehyde resin as described in U.S. Pat. No. 4,028,111 is more recommended.

To form visible images by exposure, compounds such as o-naphthoquinonediazido-4-sulfonyl chloride, inorganic anionic salts of p-diazodiphenylamine, trihalomethyloxadiazole compounds, and trihalomethyloxadiazole compounds containing a benzofuran ring are added to the photosensitive layer. On the other hand, triphenylmethane dyes such as Victoria Blue BOH, Crystal Violet, and Oil Blue are used as coloring materials of images. Dyes described in JP-A-62-293247 are particularly preferred.

Ink-receptivity enhancing agents can be incorporated into the photosensitive layer, which include novolak resins prepared by a condensation reaction of a phenol substituted by an alkyl group having 3 to 15 carbon atoms such as t-butylphenol or n-octylphenol with formaldehyde as described in JP-B-57-23253, and o-naphthoquinonediazido-4- or -5-sulfonic esters of such novolak resins as described, for example, in JP-A-61-242446).

To improve development properties, nonionic surfactants as described in JP-A-62-251740 can further be added to the photosensitive layer.

A composition comprising the above-mentioned components is dissolved in a solvent which can dissolve all the components, and then applied to a support. Examples of the solvents used for this purpose include ethylene dichloride, cyclohexanone, methyl ethyl ketone, ethylene glycol monomethyl ether, ethylene glycol monoethyl ether, 2-methoxyethyl acetate, 1-methoxy-2-propanol, 1-methoxy-2-propyl acetate, methyl lactate, ethyl lactate, dimethyl sulfoxide, dimethylacetamide, dimethylformamide, water, N-methylpyrrolidone, tetrahydrofurfuryl alcohol, acetone, diacetone alcohol, methanol, ethanol, isopropyl alcohol, and diethylene glycol dimethyl ether. These solvents can be used, singly or in combination.

A photosensitive composition comprising these components is applied to the support so as to be 0.5 to 3.0 g/m$^2$ in solid content.

[II] Formation of Photosensitive Layer Containing Diazo Resin and Water-Insoluble, Lipophilic Polymer:

Examples of diazo resins used herein include organic solvent-soluble inorganic salts of diazo resins which are prepared by reacting condensation products for example, between p-diazodiphenylamine and formaldehyde or acetaldehyde with hexafluorophosphoric acid salts or tetrafluoroboric acid salts; and organic solvent-soluble organic acid salts of diazo resins which are prepared by a reaction of the above-mentioned condensation products with sulfonic acids (for example, p-toluenesulfonic acid) or their salts, phosphinic acids (for example, benzenephosphinic acid) or their salts, or compounds containing a hydroxyl group (for example, 2,4-dihydroxybenzophenone and 2-hydroxy-4-methoxybenzophenone-5-sulfonic acid) or their salts as described in U.S. Pat. No. 3,300,309.

Other diazo resins used suitably in the present invention are copolycondensation products containing the following two structural units in molecules; aromatic compounds having at least one organic group selected from a carboxyl group, a sulfonic acid group, a sulfinic acid group, a phosphorus oxygen acid group, and a hydroxyl group, and diazonium compounds, preferably an aromatic diazonium compounds. The above-mentioned aromatic compounds preferably refer to a phenyl group or a naphthyl group.

Various compounds can be enumerated as the aromatic compounds having at least one organic group selected from a carboxyl group, a sulfonic acid group, a sulfinic acid group, a phosphorus oxygen acid group, and a hydroxyl group. Preferred examples of the aromatic compounds include 4-methoxybenzoic acid, 3-chlorobenzoic acid, 2,4-dimethoxybenzoic acid, p-phenoxybenzoic acid, 4-anilinobenzoic acid, phenoxyacetic acid, phenylacetic acid, p-hydroxybenzoic acid, 2,4-dihydroxybenzoic acid, benzene-sulfonic acid, p-toluenesulfinic acid, 1-naphthalenesulfonic acid, phenylphosphoric acid, and phenylphosphonic acid. Although the aromatic diazonium compounds which are one of the structural units of the above-mentioned copolycondensation products include diazonium salts as described, for example, in JP-B-49-48001, diphenylamine-4-diazonium salts are particularly preferred.

The diphenylamine-4-diazonium salts are derived from 4-aminodiphenylamines. Examples of such 4-aminodiphenylamines include 4-aminodiphenylamine, 4-amino-3-methoxydiphenylamine, 4-amino-2-methoxydiphenylamine, 4'-amino-2-methoxydiphenylamine, 4'-amino-4-methoxydiphenylamine, 4-amino-3-methyl-diphenylamine, 4-amino-3-ethoxydiphenylamine, 4-amino-3-β-hydroxyethoxydiphenylamine, 4-aminodiphenylamine-2-sulfonic acid, and 4-aminodiphenylamine-2-carboxylic acid. Of these compounds, 4-amino-3-methoxydiphenylamine and 4-amino-diphenylamine are particularly recommended.

In addition to the copolycondensation products of the diazo resins with the aromatic compounds having at least one acid group, diazo resins condensed with aldehydes or their acetals having an acid group as described in JP-A-4-18559, JP-A-3-163551, and JP-A-3-253857 can also be employed.

Counter anions of the diazo resins include anions which can stably form salts with the diazo resins and make the diazo resins soluble in organic solvents. These anions involve organic carboxylic acids such as decanoic acid and benzoic acid, organic phosphoric acids such as phenyl phosphoric acid, and sulfonic acids. Typical examples of the anions include aliphatic and aromatic sulfonic acids such as methanesulfonic acid, fluoroalkanesulfonic acids (for example, trifluoromethanesulfonic acid), laurylsulfonic acid, dioctyl sulfosuccinate, dicyclohexyl sulfosuccinate, camphorsulfonic acid, tolyloxy-3-propanesulfonic acid, nonylphenoxy-2-propanesulfonic acid, nonylphenoxy-4-butanesulfonic acid, dibutylphenoxy-3-propanesulfonic acid, diamylphenoxy-3-propanesulfonic acid, dinonylphenoxy-3-propanesulfonic acid, dibutylphenoxy-4-butanesulfonic acid, dinonylphenoxy-4-butanesulfonic acid, benzenesufonic acid, toluenesulfonic acid, mesithylenesulfonic acid, p-chlorobenzenesulfonic acid, 2,5-dichlorobenzenesulfonic acid, sulfosalicylic acid, 2,5-dimethylbenzenesulfonic acid, p-acetylbenzenesulfonic acid, 5-nitro-o-toluenesulfonic acid, 2-nitrobenzenesulfonic acid, 3-chlorobenzenesulfonic acid, 3-bromobenzenesulfonic acid, 2-chloro-5-nitrobenzenesulfonic acid, butylbenzenesulfonic acid, octylbenzenesulfonic acid, decylbenzenesulfonic acid, dodecylbenzenesulfonic acid, butoxybenzenesulfonic acid, dodecyloxybenzenesulfonic acid, 2-hydroxy-4-methoxybenzophenone-5-sulfonic acid, isopropylnaphthalenesulfonic acid, butylnaphthalenesulfonic acid, hexylnaphthalenesulfonic acid, octylnaphthalenesulfonic acid, butoxynaphthalenesulfonic acid, dodecyloxynaphthalenesulfonic acid, dibutylnaphthalenesulfonic acid, dioctylnaphthalenesulfonic acid, triisoropylnaphthalenesulfonic acid, tributylnaphthalenesulfonic acid, 1-naphthol-5-sulfon acid, naphthalene-1-sulfonic acid, naphthalene-2-sulfonic acid, 1,8-dinitronaphthalene-3,6-disulfonic acid, and dimethyl-5-sulfoisophthalate; aromatic compounds containing hydroxyl groups such as 2,2',4,4'-tetrahydroxybenzophenone, 1,2,3-trihydroxybenzophenone and 2,2',4-trihydroxybenzophenone; halogenated Lewis acids such as hexafluorophosphoric acid and tetrafluoroboric acid; and perhalogenic acids such as perchloric acid and periodic acid. However, usable acids are not limited to these examples in the present invention. Of these acids, particularly preferred acids are butylnaphthalenesulfonic acid, dibutylnaphthalenesulfonic acid, hexafluorophosphoric acid, 2-hydroxy-4-methoxybenzophenone-5-sulfonic acid, and dodecylbenzenesulfonic acid.

Although the molecular weights of the diazo resins used in the present invention can be arbitrarily controlled depending on the molar ratio of monomers and conditions of condensation reactions, the molecular weights effective to attain the object of the present invention are from about 400 to about 100,000, and preferably from about 800 to about 8,000.

The water-insoluble, lipophilic polymers include copolymers which are prepared from monomers given in the following (1) to (15) and normally have molecular weights of 10,000 to 200,000.

(1) Acrylamides, methacrylamides, acrylic esters, and methacrylic esters, which contain an aromatic hydroxyl group, and hydroxystyrenes. For example, N-(4-hydroxyphenyl) acrylamide, N-(4-hydroxyphenyl)methacrylamide, o-, m- and p-hydroxystyrenes, and o-, m- and p-hydroxyphenyl acrylates and methacrylates.

(2) Acrylic esters and methacrylic esters containing an aliphatic hydroxyl group. For example, 2-hydroxyethyl acrylate, 2-hydroxyethyl methacrylate, and 4-hydroxybutyl methacrylate.

(3) Unsaturated carboxylic acids such as acrylic acid, methacrylic acid, maleic anhydride, and itaconic acid.

(4) (Substituted) alkyl acrylate such as methyl acrylate, ethyl acrylate, propyl acrylate, butyl acrylate, amyl acrylate, hexyl acrylate, cyclohexyl acrylate, octyl acrylate, benzyl acrylate, 2-chloroethyl acrylate, glycidyl acrylate, and N-dimethylaminoethyl acrylate.

(5) (Substituted) alkyl methacrylate such as methyl methacrylate, ethyl methacrylate, propyl methacrylate, butyl methacrylate, amyl methacrylate, cyclohexyl methacrylate, benzyl methacrylate, glycidyl methacrylate, and N-dimethylaminoethyl methacrylate.

(6) Acrylamides and methacrylamides such as acrylamide, methacrylamide, N-methylolacrylamide, N-methylolmethacrylamide, N-ethylacrylamide, N-hexylmethacrylamide, N-cyclohexyl-acrylamide, N-hydroxyethylacrylamide, N-phenylacrylamide, N-nitrophenylacrylamide, and N-ethyl-N-phenylacrylamide.

(7) Vinyl ethers such as ethyl vinyl ether, 2-chloroethyl vinyl ether, hydroxyethyl vinyl ether, propyl vinyl ether, butyl vinyl ether, octyl vinyl ether, and phenyl vinyl ether.

(8) Vinyl esters such as vinyl acetate, vinyl chloroacetae, vinyl butyrate, and vinyl benzoate.

(9) Styrenes such as styrene, α-methylstyrene and chloromethylstyrene.

(10) Vinyl ketones such as methyl vinyl ketone, ethyl vinyl ketone, propyl vinyl ketone, and phenyl vinyl ketone.

(11) Olefins such as ethylene, propylene, isobutylene, butadiene and isoprene.

(12) N-vinylpyrrolidone, N-vinylcarbazole, 4-vinylpyridine, acrylonitrile, methacrylonitrile, etc.

(13) Unsaturated imides such as maleimide, N-acryloylacrylamide, N-acetylmethacrylamide, N-propionylmethacrylamide, and N-(p-chlorobenzoyl) methacrylamide

(14) Unsaturated sulfonamides including methacrylamides such as N-(o-aminosulfonylphenyl)methacrylamide, N-(m-aminosulfonylphenyl)methacrylamide, N-(p-aminosulfonylphenyl)methacrylamide, N-(1-(3-aminosulfonyl)naphthyl)methacrylamide, and N-(2-aminosulfonylethyl)methacrylamide; acrylamides containing the same substituent groups as above; methacrylic esters such as o-aminosulfonylphenyl methacrylate, m-aminosulfonylphenyl methacrylate, p-aminosulfonylphenyl methacrylate, and 1-(3-aminosulfonylnaphthyl) methacrylate; and acrylic esters containing the same substituent groups as above.

(15) Unsaturated monomers containing a crosslinking group in a side chain such as N-(2-(methacryloyloxy)ethynyl)-2,3-dimethylmaleimide and vinyl cinnamate. Further, copolymers of the above monomers copolymerized with other monomers.

(16) Phenol resins described in U.S. Pat. No. 3,751,257 and polyvinyl acetal resins such as polyvinyl formal resins and polyvinyl butyral resins.

(17) Polyurethanes which are made alkali-soluble described in JP-B-54-19773, JP-A-57-94747, JP-A-60-182437, JP-A-62-58242, JP-A-62-123452, JP-A-62-123453, JP-A-63-113450, and JP-A-2-146042.

Preferred molecular weights of the above-mentioned copolymers are from 10,000 to 200,000.

Polyvinyl butyral resins, polyurethane resins, polyamide resins, epoxy resins, novolak resins, and natural resins may be added to the above-mentioned copolymers as needed.

In the present invention, the photosensitive composition can contain dyes to obtain visible images by exposure and visible images after development. Examples of such color-changing agents whose colors disappear or change to different colors include triphenylmethane dyes such as Victoria Pure Blue BOH (manufactured by Hodogaya Chemical Co., Ltd.), Oil Blue #603 (Orient Chemical Co., Ltd.), Patent Pure Blue (Sumitomo Mikuni Chemical Co., Ltd.), Crystal Violet, Brilliant Green, Ethyl Violet, Methyl Violet, Methyl Green, Erythrosine B, Basic Fuchsine, Malachite Green, Oil Red, m-Cresol Purple, Rhodamine B, Auramine, 4-p-diethylaminophenyl-iminonaphthoquinone, and cyano-p-diethylaminophenyl-acetanilide; diphenylmethane dyes; oxazine dyes; xanthene dyes; iminonaphthoquinone dyes; azomethine dyes; and anthraquinone dyes.

On the other hand, examples of colorless color-changing agents which generate colors include leuco dyes, and primary, secondary, and tertiary arylamine dyes represented by triphenylamine, diphenylamine, o-chloro-aniline, 1,2,3-triphenylguanidine, naphthylamine, diaminodiphenylmethane, p,p'-bis(dimethylamino) diphenylamine, 1,2-diaminodiphenylmethane, p,p',p"-tris (dimethylamino)-triphenylmethane, p,p'-bis (dimethylamino)diphenylmethylimine, p,p',p"-triamino-o-methyltriphenylmethane, p,p'-bis(dimethylamino)diphenyl-4-anilinonaphthylmethane, and p,p',p"-triaminotriphenylmethane. Of these dyes, favorable dyes are triphenylmethane dyes and diphenylmethane dyes, more favorable ones are triphenylmethane dyes, and most favorable one is Victoria Pure Blue BOH.

Various additives can further be incorporated into the photosensitive composition of the present invention.

Examples of the additives employed preferably include alkyl ethers (for example, ethyl cellulose and methyl cellulose), fluorine type surfactants, and nonionic surfactants to improve coating properties (fluorine type surfactants are preferred); plasticizers to give flexibility and resistance to wear to film (for example, butyl phthalyl, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, oligomers and polymers of acrylic acid or methacrylic acid. Of these plasticizers, tricresyl phosphate is particularly preferred); ink-receptivity enhancing agents to improve ink receptivity of image areas (for example, styrene/maleic anhydride copolymers half-esterified by alcohols as described in JP-A-55-527, novolak resins such as p-t-butylphenol/formaldehyde resins and p-hydroxystyrene in which 50% of the hydroxyl groups are esterified by aliphatic acid); stabilizers (for example, phosphoric acid, phosphorous acid, organic acids such as citric acid, oxalic acid, dipicolinic acid, benzenesulfonic acid, naphthalenesulfonic acid, sulfosalicylic acid, 4-methoxy-2-hydroxybenzophenone-5-sulfonic acid, and tartaric acid); development accelerators (for example, higher alcohols and acid anhydrides).

To apply the above-mentioned photosensitive composition to a support, the photosensitive diazo resins, the lipophilic polymers and other additives used as needed are dissolved in the respective appropriate amounts in a suitable solvent (methyl cellosolve, ethyl cellosolve, dimethoxyethane, diethylene glycol monomethyl ether, diethylene glycol dimethyl ether, 1-methoxy-2-propanol, methyl cellosolve acetate, acetone, methyl ethyl ketone, methanol, dimethylformamide, dimethylacetamide, cyclohexanone, dioxane, tetrahydrofuran, methyl lactate, ethyl lactate, ethylene dichloride, dimethyl sulfoxide, water, or mixtures thereof) to prepare a solution of the photosensitive compositions, applied to the support, and then dried.

Although the solvents can be singly used, it is more favorable to use a mixture of a high-boiling solvent such as methyl cellosolve, 1-methoxy-2-propanol and methyl lactate with a low-boiling solvent such as methanol and methyl ethyl ketone. The concentrations of solid contents in the solution of the photosensitive composition preferably range from 1 to 50% by weight. Then, the amount of the photosensitive composition to be applied to the support is generally from 0.2 to 10 g/m$^2$ (dry weight), and preferably from 0.5 to 3 g/m$^2$.

[III] Formation of Photosensitive Layer Containing Photodimerization Type Photosensitive Composition and Photopolymerizable Photosensitive Composition:

Photodimerization type photosensitive compositions contain a maleimido group, a cinnamyl group, a cinnamoyl group, a cinnamylidene group, a cinnamylideneacetyl group, or a chalcone group in the side chains or main chains of molecules. Polymers containing the maleimido group in the side chains include polymers described in JP-A-52-988 (corresponding to U.S. Pat. No. 4,079,041), German Patent 2,626,769, European Patents 21,019 and 3,552, and Die *Angewandte Makromolekulare Chemie*, 115, 163–181 (1983); and polymers described in JP-A-49-128991, JP-A-49-128992, JP-A-49-128993, JP-A-50-5376, JP-A-50-5377, JP-A-50-5379, JP-A-50-5378, JP-A-50-5380, JP-A-53-5298, JP-A-53-5299, JP-A-53-5300, JP-A-50-50107, JP-A-51-47940, JP-A-52-13907, JP-A-50-45076, JP-A-52-121700, JP-A-50-10884, JP-A-50-45087, and German Patents 2,349,948 and 2,617,276.

To make these polymers aqueous alkali-soluble or aqueous alkali-swelling, it is useful for the polymers to contain carboxylic acid, sulfonic acid, phosphoric acid, phosphonic acid, or their alkali metal salts or ammonium salts, or an acid group having a p$K_a$ of 6 to 12 which dissociates in aqueous alkali. It also is possible to copolymerize one to three kinds of monomers having these acid groups with a monomer having a maleimido group.

The acid value of maleimido polymers having the acid groups preferably ranges from 30 to 300. Of the polymers having such acid values, useful ones are copolymers of N-[2-(methacryloyloxy)ethyl]-2,3-dimethylmaleimide with methacrylic acid or acrylic acid as described in *Die Anqewandte Makromolekulare Chemie*, 128, 71–91 (1984). Further, ternary copolymers answering the purposes can be easily prepared by copolymerizing a third vinyl monomer on synthesis of the above-mentioned copolymers. For example, use of alkyl methacrylates or alkyl acrylates as the third vinyl monomer, in which glass transition points of their homopolymers are room temperature or less, makes it possible to give flexibility to the resulting copolymers.

Photocrosslinking polymers containing a cinnamyl group, a cinnamoyl group, a cinnamylidene group, a cinnamylideneacetyl group, or a chalcone group in the side chains or main chains of molecules include photosensitive polyesters described in U.S. Pat. No. 3,030,208, U.S. patent application Ser. Nos. 709,496 and 828,455.

Aqueous alkali-soluble photocrosslinking polymers made of the above-mentioned photocrosslinking polymers include the following compounds; photosensitive polymers as described in JP-A-60-191244 and photosensitive polymers as described in JP-A-62-175729, JP-A-62-175730, JP-A-63-25443, JP-A-63-218944, and JP-A-63-218945.

Sensitizers can be used for the photosensitive layers containing these polymers. Examples of such sensitizers include benzophenone derivatives, benzanthrone derivatives, quinones, aromatic nitro compounds, naphthothiazoline derivatives, benzothiazoline derivatives, thioxanthones, naphthothiazole derivatives, ketocoumarin compounds, benzothiazole derivatives, naphthofuranone compounds, pyrylium salts, and thiapyrylium salts. These photosensitive layers can contain as needed binders such as chlorinated polyethylene, chlorinated polypropylene, poly (alkyl acrylate), copolymers thereof with at least one kind of monomer such as alkyl acrylate, acrylonitrile, vinyl chloride, styrene, and butadiene, polyamides, methyl cellulose, polyvinyl formal, polyvinyl butyral, methacrylic acid copolymers, acrylic acid copolymers, and itaconic acid copolymers; and plasticizers such as dialkyl phthalates (for example, dibutyl phthalate and dihexyl phthalate), oligoethylene glycol alkyl esters, and phosphoric esters. To color the photosensitive layers, dyes or pigments, or pH indicators as print-out agents may be preferably added thereto.

Photopolymerizable photosensitive compositions include unsaturated carboxylic acids and their salts, unsaturated carboxylic esters with aliphatic polyhydric alcohols, and unsaturated carboxylic acid amides with aliphatic polyamine compounds.

Examples of photopolymerization initiators include vic-polyketoaldonyl compounds, α-carbonyl compounds, acyloin ethers, aromatic acyloin compounds substituted by hydrocarbon groups at the α-positions, polynuclear quinone compounds, combinations of triarylimidazole dimer and p-aminophenylketone, benzothiazole compounds, trihalomethyl-s-triazine compounds, acridine and phenazine compounds, and oxadiazole compounds. Aqueous alkali-soluble or aqueous alkali-swelling and film-formable polymers include copolymers of benzyl (meth)acrylate, (meth) acrylic acid and other addition-polymerizalbe vinyl monomers added as needed; copolymers of methacrylic acid and methyl methacrylate (or methacrylic acid esters); maleic anhydride copolymers which are half esterified by addition of pentaerythritol triacrylate; and acidic vinyl copolymers.

[IV] Electrophotographic Photosensitive Layer:

A ZnO photosensitive layer disclosed, for example, by U.S. Pat. No. 3,001,872 can be employed. Further, photosensitive layers containing electrophotographic photosensitive materials described in JP-A-56-161550, JP-A-60-186847, and JP-A-61-238063 may also be employed.

The amount of the photosensitive layers provided on the supports ranges from about 0.1 to about 7 g/m$^2$, and preferably from 0.5 to 4 g/m$^2$ in dry weight.

In the present invention, interlayers can be provided as needed to enhance the adhesion between the photosensitive layers and the supports, to leave no photosensitive layers on the supports after development, or to prevent halation.

To enhance the adhesion, the interlayers generally comprise diazo resins, and, for example, phosphoric acid compounds, amino compounds or carboxylic acid compounds which are adsorbed in aluminum. The interlayers comprising substances having high solubility to leave no photosensitive layers on the supports after development contain polymers having good solubility or water-soluble polymers in general. To prevent the halation, the interlayers contain dyes or UV absorbing agents in general. Although the interlayers can have an arbitrary thickness, they are require to have a thickness enough to endure an uniform bond formation reaction with the upper photosensitive layers. In general, the amount of the interlayers formed is preferably from about 1 to about 100 mg/m$^2$, and particularly preferably from about 5 to about 40 mg/m$^2$ in dry weight.

A matte layer constituted of projections isolated from one another can also be provided on the photosensitive layer. The matte layer is provided to improve vacuum contact between a negative image film and a photosensitive lithographic printing plate on contact exposure, which shortens evacuation time, and further, prevents halftone dots from plugging owing to poor contact on exposure.

The methods for forming the matte layer include a method of heat fusing powdered solid described in JP-A-55-12974 and a method of spraying polymer-containing water and then drying described in JP-A-58-182636. Although any method can be used, it is desirable that the matte layer itself dissolve in an aqueous alkali developer substantially containing no organic solvent, or can be removed by the developer.

The photosensitive lithographic printing plate thus prepared is subjected to image exposure, and subsequently, to processing including development according to conventional procedures, thus forming a resin image. For example, the photosensitive lithographic printing plate having the photosensitive layer of the above-mentioned [I], after the image exposure, is developed with an aqueous alkali solution as described in U.S. Pat. No. 4,259,434 to remove the layer of exposed areas, obtaining a lithographic printing plate; and in the photosensitive lithographic printing plate having the photosensitive layer of [III], after the image exposure, the photosensitive layer of unexposed areas is removed by a developer as described in U.S. Pat. No. 4,186,006 to obtain a lithographic printing plate. To develop a positive type lithographic printing plate as described in JP-A-59-84241, JP-A-57-192952 and JP-A-62-24263, an aqueous alkali developer composition can also be employed.

EXAMPLE

A wrought aluminum in accordance with JIS member 1050 was selected as a brush material to obtain the bending elastic moduli and nerves of brush bristles given below (see Table 1). A device described in JP-A-50-40047 was used to rotate the brush at 300 rpm. The average particle sizes and specific gravity of abrasive materials were varied to prepare grained samples.

TABLE 1

| | Brush Bristles | | Abrasive Materials | |
|---|---|---|---|---|
| Samples | Bending Elastic Modulus (kg/cm$^2$) | Nerve (g) | Average Particle Sizes ($\mu$m) | Specific Gravity |
| A (Example) | 24,000 | 10 | 45 | 2.5 |
| B (Example) | 24,000 | 50 | 45 | 2.5 |
| C (Example) | 24,000 | 150 | 45 | 2.5 |
| D (Example) | 24,000 | 150 | 5 | 2.5 |
| E (Example) | 24,000 | 150 | 100 | 2.5 |
| F (Example) | 24,000 | 150 | 50 | 1.5 |
| G (Example) | 24,000 | 500 | 45 | 2.5 |
| H (Comparative Example) | 24,000 | 1,000 | 45 | 2.5 |
| I (Comparative Example) | 24,000 | 4,000 | 45 | 2.5 |
| J (Comparative Example) | 5,000 | 50 | 45 | 2.5 |
| K (Comparative Example) | 50,000 | 4,000 | 45 | 2.5 |
| L (Comparative Example) | 50,000 | 500 | 45 | 2.5 |
| M (Comparative Example) | 40,000 | 600 | 45 | 2.5 |
| N (Comparative Example) | 10,000 | 600 | 45 | 2.5 |
| O (Comparative Example) | 5,000 | 600 | 45 | 2.5 |
| P (Example) | 10,000 | 500 | 45 | 2.5 |
| Q (Example) | 40,000 | 500 | 45 | 2.5 |

In addition to sample A to Q shown in the table, sample R was prepared by graining sample K under the conditions for sample B. These samples were etched with 15% caustic soda so as to be 8 g/m$^2$ in amount of dissolved aluminum, and desmutted with 3% nitric acid. Subsequently, the surfaces of the samples were roughened by use of alternating current waveform described in JP-B-55-19191 in 13 g/liter of nitric acid and 5 g/liter of aluminum at 40° C. They were electrochemically roughened at an anode electricity quantity of 250 C/dm$^2$ and a current density of 25 A/dm$^2$, and subsequently, etched with 10% caustic soda so as to be 1.5 g/m$^2$ in amount of dissolved aluminum, and desmutted with 20% sulfuric acid at 50° C. for 15 seconds. An anode oxide film in an amount of 2.5 g/m$^2$ was formed in 140 g/liter sulfuric acid, and washed with water. Samples A to R were thus prepared.

The following composition was applied to the supports thus prepared so as to be 2.0 g/m$^2$ in dry weight to form photosensitive layers on them.

Composition of Photosensitive Layer:

| | |
|---|---|
| Esterification Product of Naphthoquinone-1,2-diazido-5-sulfonyl Chloride with Pyrogallol/Acetone Resin (Described in Example 1 of U.S. Pat. No. 3,635,709) | 0.75 g |
| Cresol Novolak Resin | 2.00 g |
| Oil Blue #603 (Manufactured by Orient Chemical Co., Ltd.) | 0.04 g |
| Ethylene Dichloride | 16 g |
| 2-Methoxyethyl Acetate | 12 g |

The printing plates thus prepared were exposed to light in a vacuum frame through a transparent positive film from a distance of 1 meter with a 3-kw metal halide lamp for 50 seconds, developed with a 5.26% aqueous solution of sodium silicate ($SiO_2/Na_2O$ molar ratio: 1.74), and subjected to printing to evaluate the scumming reduction on squeezing water out and the printing durability thereof.

The result of the evaluation is shown in TABLE 2 where "A" means "superior", "B" means "excellent", "C" means "good", "D" means "practical", "E" means "bad", and "F" means "the worst".

TABLE 2

| Samples | Scumming Reduction | Printing Durability (the number of clear copies) ($\times 10^4$ sheets) |
|---|---|---|
| A (Example) | A | 10 |
| B (Example) | A | 11 |
| C (Example) | B | 11 |
| D (Example) | B | 8 |
| E (Example) | C | 10 |
| F (Example) | B | 8 |
| G (Example) | C | 10 |
| H (Comparative Example) | D | 8 |
| I (Comparative Example) | E | 7 |
| J (Comparative Example) | B | 2 |
| K (Comparative Example) | E | 8 |
| L (Comparative Example) | F | 6 |
| M (Comparative Example) | E | 5 |
| N (Comparative Example) | E | 6 |
| O (Comparative Example) | D | 6 |
| P (Example) | B | 10 |
| Q (Example) | C | 11 |
| R (Comparative Example) | E | 6 |

As shown in Table 2, it is found that excellent printability can be acquired by the practice of the present invention.

In the process for manufacturing a lithographic printing plate support made of aluminum or an aluminum alloy, when the surface of the support is at least mechanically roughened by graining it with a brush comprising bristles which have a bending elastic modulus of 10,000 to 40,000 kg/cm$^2$ and a nerve of 500 g or less per bristle, generation of defective products due to defects such as scratching which aluminum itself has can be prevented and a lithographic printing plate support having scumming reduction even on squeezing water out can be manufactured.

While the invention has been described in detail and with reference to specific embodiments thereof, it will be apparent to one skilled in the art that various changes and modifications can be made therein without departing from the spirit and scope thereof.

What is claimed is:

1. A process for manufacturing a lithographic printing plate support made of aluminum or an aluminum alloy, in which a surface of the support is mechanically roughened by graining it with a brush comprising bristles which have a bending elastic modulus of 10,000 to 40,000 kg/cm$^2$ and a nerve of 500 g or less per bristle.

2. A process for manufacturing a lithographic printing plate support as claimed in claim 1, in which the surface of the support is mechanically roughened by use of an abrasive material having an average particle size from 10 to 80 $\mu$m.

3. A process for manufacturing a lithographic printing plate support as claimed in claim 2, in which said abrasive material has a specific gravity of 2 or more.

4. A process for manufacturing a lithographic printing plate support as claimed in claim 1, in which the surface of the support is mechanically roughened by use of an abrasive material having an average particle size from 20 $\mu$pm to 60 $\mu$m.

5. A process for manufacturing a lithographic printing plate support as claimed in claim 4, in which said abrasive material has a specific gravity from 2.5 to 8.

* * * * *